US005171101A

United States Patent [19]

Sauerbier et al.

[11] Patent Number: 5,171,101

[45] Date of Patent: Dec. 15, 1992

[54] SURFING-WAVE GENERATORS

[75] Inventors: Charles E. Sauerbier, San Luis Obispo; Thomas J. Lochtefeld, San Diego, both of Calif.

[73] Assignee: Light Wave, Ltd., La Jolla, Calif.

[21] Appl. No.: 795,231

[22] Filed: Nov. 15, 1991

Related U.S. Application Data

[63] Continuation of Ser. No. 525,562, May 17, 1990, abandoned, which is a continuation of Ser. No. 286,964, Dec. 19, 1988, Pat. No. 4,954,014, which is a continuation-in-part of Ser. No. 54,521, May 27, 1987, Pat. No. 4,792,260.

[51] Int. Cl.[5] ..... A63B 69/00

[52] U.S. Cl. ..... 405/79

[58] Field of Search ..... 405/79, 80, 52, 21; 4/491; 272/17, 1 B

[56] References Cited

U.S. PATENT DOCUMENTS

| | | |
|---|---|---|
| 799,708 | 9/1905 | Boyce . |
| 1,655,498 | 1/1928 | Fisch . |
| 1,701,842 | 2/1929 | Fisch . |
| 1,871,215 | 8/1932 | Keller et al. . |
| 1,884,075 | 10/1932 | Meyers . |
| 2,815,951 | 12/1957 | Baldanza . |
| 3,005,207 | 10/1961 | Matrai . |
| 3,038,760 | 6/1962 | Crooke . |
| 3,085,404 | 4/1963 | Smith . |
| 3,473,334 | 10/1969 | Dexter . |
| 3,477,233 | 11/1969 | Andersen . |
| 3,478,444 | 11/1969 | Presnell et al. . |
| 3,562,823 | 2/1971 | Koster . |
| 3,598,402 | 8/1971 | Frenzl . |
| 3,789,612 | 2/1974 | Richard et al. . |
| 3,802,697 | 4/1974 | Le Mehaute . |
| 3,851,476 | 12/1974 | Edwards . |
| 3,913,332 | 10/1975 | Forsman . |
| 3,981,612 | 9/1976 | Bunger et al. . |
| 4,201,496 | 5/1980 | Andersen . |
| 4,276,664 | 7/1981 | Baker . |
| 4,522,535 | 6/1985 | Bastenhof . |
| 4,539,719 | 9/1085 | Schuster et al. . |
| 4,564,190 | 1/1986 | Frenzl . |
| 4,662,781 | 5/1987 | Tinkler . |
| 4,790,685 | 12/1988 | Scott et al. . |
| 4,792,260 | 12/1988 | Sauerbier . |
| 4,904,484 | 1/1893 | Mackaye . |
| 4,905,987 | 3/1990 | Frenzi . |
| 4,954,014 | 9/1990 | Sauerbier et al. . |

FOREIGN PATENT DOCUMENTS

| | | | |
|---|---|---|---|
| 159793 | 8/1903 | Fed. Rep. of Germany . | |
| 373684 | 7/1932 | Fed. Rep. of Germany . | |
| 2222594 | 5/1972 | Fed. Rep. of Germany . | |
| 271412 | 10/1978 | Fed. Rep. of Germany . | |
| 1019527 | 10/1952 | France . | |
| 1300144 | 6/1962 | France . | |
| 1539959 | 8/1968 | France . | |
| 52-41392 | 3/1977 | Japan . | |
| WO83/04375 | 12/1983 | PCT Int'l Appl. . | |
| WO90/06790 | 6/1990 | PCT Int'l Appl. . | |
| 212138 | 4/1968 | U.S.S.R. . | |
| 0953075 | 8/1982 | U.S.S.R. ..... | 405/79 |
| 953075 | 8/1982 | U.S.S.R. . | |
| 1090262 | 2/1965 | United Kingdom . | |
| 1118083 | 3/1966 | United Kingdom . | |
| 1159269 | 11/1967 | United Kingdom . | |

OTHER PUBLICATIONS

Killen, P. D.; Model Studies for a Wave Riding Facility, Aug. 18-22, 1980.

Hornung & Killen; A Stationary Oblique Breaking Wave for Laboratory Testing of Surfboards, May 7, 1976.

Killen & Stalker; A Facility for Wave Riding Research, Nov. 28/Dec. 2, 1983.

*Primary Examiner*—Dennis L. Taylor

*Attorney, Agent, or Firm*—Knobbe, Martens, Olson & Bear

[57] ABSTRACT

A wave-forming generator for generating inclined surfaces on a contained body of water. The water is propelled against the surface-shaping generator with sufficient force to impart the desired shape to the water surface, and the generated surfaces can include waves, such as tunnel waves, appropriate for surfing and other water skimming manuevers on the surface of a body of water. Surfaces generated can require a wide range of skills to negotiate, from beginning to advanced levels. The surfaces generated are substantially stationary with respect to the water containment means, the water itself moving with respect thereto.

4 Claims, 5 Drawing Sheets

FIG.

FIG. 2
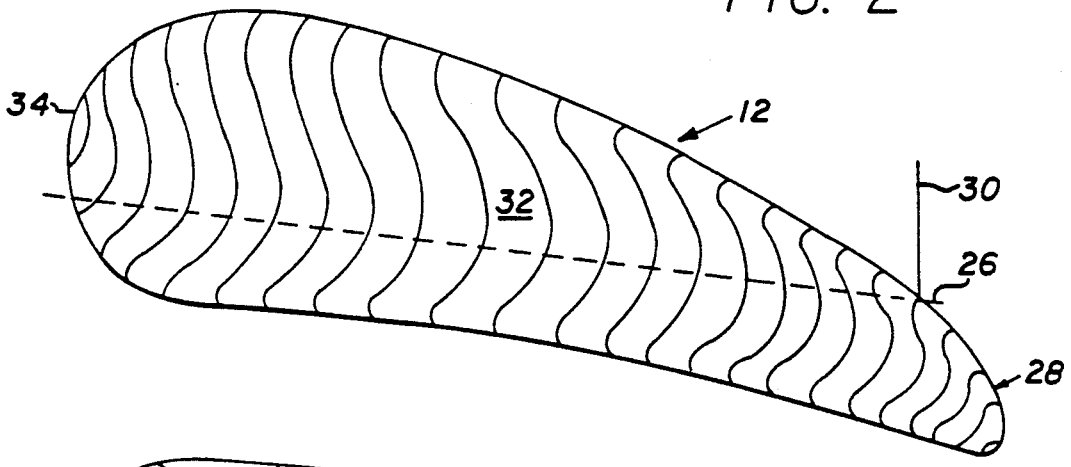
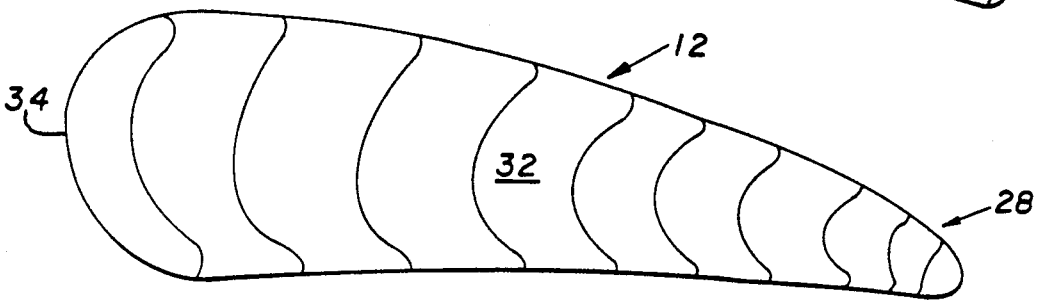
FIG. 3
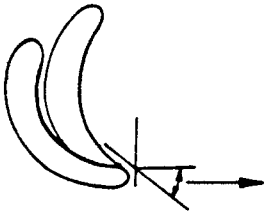
FIG. 6
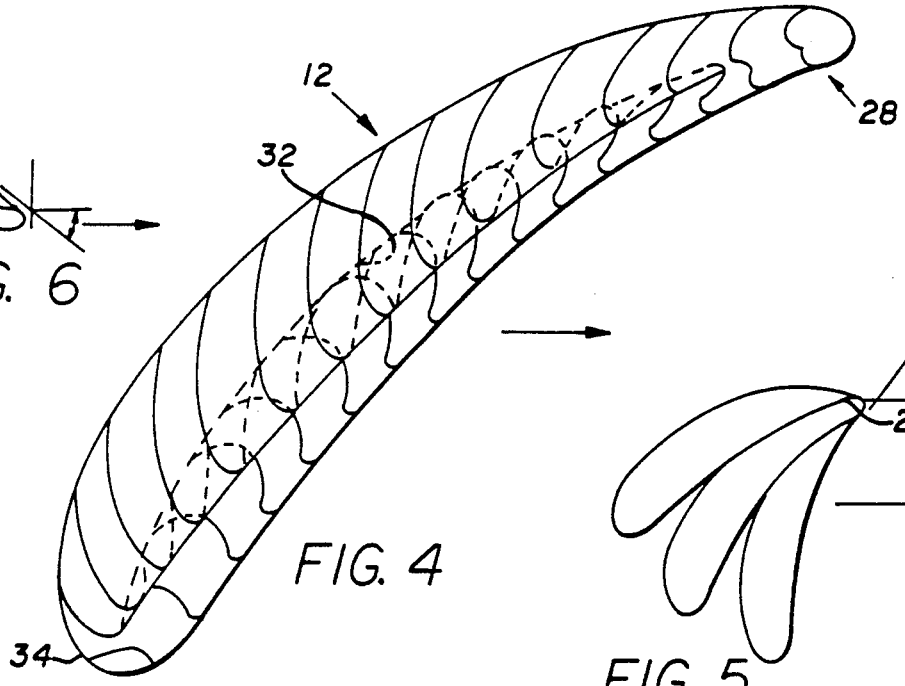
FIG. 4
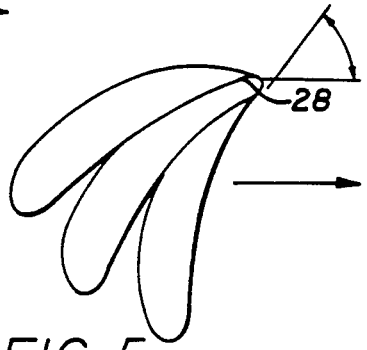
FIG. 5

SURFING-WAVE GENERATORS

This application is a continuation of Ser. No. 07/525,562, filed May 17, 1990, now abandoned, which is a continuation of Ser. No. 07/286,964, filed Dec. 19, 1988, now U.S. Pat. No. 4,954,014, which is a continuation-in-part of application Ser. No. 07/054,521, filed May 27, 1987, now U.S. Pat. No. 4,792,260.

The present invention relates, in general, to a facility providing a body of water having an inclined surface thereon of an area, depth and slope sufficient to permit surfboarding and other water-skimming activity and, in particular, to several embodiments of means for generating and maintaining said inclined surface, including means for generating surfing wave shapes including tunnel waves.

BACKGROUND OF THE INVENTION

Surfing, as a sport, has attracted enthusiasts all over the world, and many of them travel long distances to locations where ideal surfing conditions exist. Particularly prized by expert surfers are the waves called "the chute" or "the pipeline", that is, waves which move with sufficient velocity and height that, when they encounter an upwardly sloping bottom of certain configuration, curl forward over the advancing base of the wave to form a tunnel, inside, at the mouth, or on top of which expert surfers move laterally across the face of the wave, seeking to keep pace with the formation of the tunnel without being caught in the collapsing portion thereof.

The formation of such waves under natural conditions requires a comparatively rare combination of factors, including wind of a certain constancy of velocity and direction, and waves of a certain velocity, direction and height, approaching a shore having a certain bottom slope and configuration. Apparently there are not many places in the world with such a favorable combination of characteristics, and surfers will travel thousands of miles to reach locations, many of them in remote areas, where such conditions exist.

Because such waves depend upon a favorable coincidence of several factors, there are few places where succeeding waves can be counted upon to be uniform for extended periods, and this militates against surfing becoming a competitive sport, that is, one in which different surfers can be rated on their skill and performance under identical conditions.

If one were to place surfing waves on a spectrum of beginning to expert, the parent invention focuses on forming a moving wave shape that will consistently produce a riding surface prized by experts. The present invention, on the other hand, produces wave-shapes of the same kind as that of the parent invention but which are stationary with respect to the physical surroundings and, in addition, also produces different stationary wave-shapes prized by beginners, i.e., non-breaking wave shapes with no whitewater turbulence thereon, as it is much easier for a beginner to learn and maintain balance and turn upon the gentle slope of a non-breaking wave than upon a spilling or plunging breaker.

Several attempts have been made to form such waves artificially, but none to date have been able to produce the wave-shapes as produced by the parent and present inventions, as an examination of some representative references will reveal.

Matrai U.S. Pat. No. 3,005,207, issued Oct. 24, 1961, discloses a swimming pool with an oscillating paddle in a deep chamber which provides simulated ocean waves for the enjoyment of swimmers and bathers in both deep and shallow portions of the pool, respectively. The structure and operation of Matrai has no relavance to the present invention.

Dexter U.S. Pat. No. 3,473,334, issued Oct. 21, 1969, discloses a wavemaking apparatus which depends upon the release of a large volume of water into a pool, with the wave shape being created by the shape of the water outlet or be the contour of the pool bottom. Although Dexter can produce breaking waves—"breakers"—they are not the tunnel waves desired by expert surfers, nor the stationary inclined water surface which permits other types of water skimming activities, and the structure and operation of Dexter has no relevance to the present invention.

Andersen U.S. Pat. No. 3,477,233, issued Nov. 11, 1969, discloses a wave-making machine for producing gravity waves on the surface of a liquid, for use in mixing liquids, breaking up ice formations, etc. The structure and operation of Andersen '233 has no relevance to the present invention.

Koster U.S. Pat. No. 3,562,823, issued Feb. 16, 1971, discloses a wave-making machine for swimming pools, which depends upon the back and forth movement of a vane in a pool of water to create a wave, and utilzes a resonance effect to minimize energy usage and obtain desired large waves. The structure and operation of Koster has no relevance to the present invention.

Richard et al U.S. Pat. No. 3,789,612, issued Feb. 5, 1974, discloses a method of wave generation which depends upon periodic up-and-down movements of a massive body in water, coupled with shaped bottom and shoreline contours, to create waves of desired shape and size, perhaps utilizing a resonance principle. The structure and operation of Richard et al has no relevance to the present invention.

Mehaute U.S. Pat. No. 3,802,697, issued Apr. 9, 1974, discloses a wave generator for simulated surfriding which depends upon the movement of a triangular ramp-shaped structure through a body of water, which is lifted up and over the ramp, creating a "hydraulic jump" wave on the surface. The structure and operation of Mehaute has no relevance to the present invention, in that the present invention does not require a "hydraulic jump" wave in order to function. Moreover, Mehaute has no way, implicitly or explicitly, to create an inclined surface on a body of water that will permit surfriding without producing a "hydraulic jump" wave.

Andersen U.S. Pat. No. 4,201,496, issued May 6, 1980, discloses a further improvement on the wavemaking machine of Andersen '233, above, which depends upon the periodic up-and-down movement of a massive body in water to create the desired waves, perhaps using a resonance effect. The structure and operation of Anderson '496 has no relevance to the present invention.

Baker U.S. Pat. No. 4,276,664, issued Jul. 7, 1981, discloses an apparatus for wave making which also, like Andersen '496, depends upon periodic up-and-down movements of a massive body in water to create desirable waves, perhaps exploiting a resonance effect. The structure and operation of Baker has no relevance to the present invention.

Bastenhof U.S. Pat. No. 4,522,535, issued Jun. 11, 1985, discloses a surf wave generator which depends upon the release of a large volume of water into a pool, with the wave shape being created by the contour of the pool bottom. The structure and operation of Bastenhof has no relevance to the present invention, as he has no means of creating a stably-shaped body of water with a permanently inclined surface thereon.

Schuster et al U.S. Pat. No. 4,538,719, issued Sep. 10, 1985, discloses a method and pneumatic apparatus which, like Bastenhof, also depends upon the release of a large volume of water into a pool for surf wave production, with the wave shape being created by the contour of the pool bottom. The structure and operation of Schuster has no relevance to the present invention, as he has no means of creating a stablyshaped body of water with a permanently inclined surface thereon.

The wave-making structure disclosed in Forsman U.S. Pat. No. 3,913,332, issued Oct. 21, 1975, is perhaps more closely related in structure to two embodiments of the parent and present invention than any of the previously discussed references. Forsman discloses a continuous wave surfing facility, which uses a wave-forming generator consisting of a single or double plow-shaped blade moving through an annularly-shaped body of water to form surfing waves of desired shape and size. Both single and double wave-forming blades are disclosed, propelled by a vehicle which moves along annular rails, submerged or otherwise, and generates a continuous wave for each blade which is suitable for surfing. Multiple generators can be employed to produce serial waves so that several surfers can enjoy the facility simultaneously. Provision is made for changing wave characteristics by changing the horizontal angle of the blades relative to the direction of motion, the leading edge of the blade, whether double or single, being hinged.

However, Forsman does not recognize, either explicitly or implicitly, some of the problems solved by the present and parent inventions, among which are the generation of tunnel waves, either standing or moving, and the generation of an inclined surface on a stably-shaped stationary body of water. In fact, the structure of Forsman, and the description of its operation, indicate that the waves generated by the Forsman generator are different than most of those generated by the present or parent invention, and they are generated in a different way. Forsman specifically describes his waves as decreasing in height the more remote they are from the generator, with the result that:

> "higher and more challenging wave height will be found close to the (generator) while less challenging waves will be found away from the (generator) thereby providing a range from beginner to expert. A skilled surfer can choose any point along the wave and easily move to reach it by moving sideways along the wave, as well as riding high up on the wave or at its base." (Forsman, col. 4, lines 39–46).

With the wave shapes generated by applicant's tunnel-wave generator (both moving and stationary), however, the more skilled surfer would seek to ride further away from the generator, at that precise point on the wave which would place him at the mouth of, or inside, the tunnel or "pipeline". However, not even an expert, and still less a novice, would seek to ride in the region where the wave was breaking, which is beyond the end of the tunnel. Further, Forsman has no means of generating a wave-shape with an inclined surface thereon.

BRIEF DESCRIPTION OF THE PRESENT INVENTION

A primary objective of the parent and the present invention is the provision of a wave generator for generating surfing wave-shapes of the kind prized by expert surfers, that is, tunnel waves, which have a mouth and an enclosed tunnel extending for some distance into the interior of the forward face of the wave-shape.

An equally important objective of the present invention is the provision of a wave-shape generator for generating surfing wave-shapes of the kind prized by novice surfers, that is, gentle sloping non-breaking waves, which are steep enough to slide down but not so steep as to be unforgiving if an error of balance or movement is made. In that regard, the present invention comprises a method and apparatus for generating a body of water with a stable shape and an inclined surface thereon, the water of said body of water moving up said inclined surface with a first velocity, and the slope of said inclined surface sufficient to permit an object floating thereon to slide down said inclined surface with a velocity at least equal to the negative value of said first velocity.

The present invention does not create a "wave", as that term is commonly known by those skilled in the art, but creates a flow of water that is "wave-shaped". The flow of water over the surface of the generator hull or inclined surface, as described hereinafter, is not technically creating a wave (i.e., the propagation from point-to-point of a disturbance or oscillation—e.g., a "hydraulic jump"), but is simulating a riding surface or shape of that portion of a wave that is of highest value and interest to surfers, from beginners to advanced.

It is to be understood by the terms:

1. "body of water": Applicant means a volume of water with a shape thereof at least of a length, breadth and depth sufficient to permit surfing manuevers thereon;
2. "stationary", Applicant means that the principal shape and dimensions of said body of water do not change significantly with the passage of time, even though the water comprising that body is is constantly changing; and
3. "inclined surface", Applicant means that the surface of said body is tilted with respect to the horizontal, and the water moves up and/or across the slope of the incline.
4. "stable (stably)", Applicant means a continuously flowing body of water having sufficient depth at its lowest point to permit surfing body or board type maneuvers thereon.

The distinctive feature of the tunnel-wave generator is the provision of a waveforming generator or hull which has a concave shape, not only vertically, but also horizontally or laterally, so that an infinitesmal body of water, moving along the face of the generator hull, encounters an increasing force, which is primarily vertical and forward, as it travels along the curved face of the generator hull. This increasing force accelerates the water, forcing it upward and forward, above the surrounding body of water and the face of the generator, so that the force of gravity can overcome its upward and forward momentum and cause it to fall in a curving arc, back to the base of the advancing wave. If the forward speed of the water is sufficient, its path will form a loop. A sheet of water, which the generator intercepts will form a tunnel, at the mouth of, or within, which expert surfers seek to ride their surfboards.

The distinctive feature of the stationary body of water which has an inclined surface is that the water moves up and/or across the inclined surface, while the shape of the body of water can eitherremain stationary with respect to its containment means or can flow on to some other use. The water of the inclined surface has a length, width and depth sufficient to permit surfing or water skimming activities thereon. If a containment means is used, it may comprise an upwardly sloping channel sufficient to provide said width, and a length and depth sufficient to provide the length and depth required for adequate surfing maneuvers.

The primary difference between the parent invention and the existing art is that the generator of the parent invention includes a curvature in horizontal section as well as in vertical cross section, and identifies limits on the shape, amount, and degree of curvature, both horizontally and vertically; upon the attitude and inclination of the generator with respect to the surface of the water and direction of motion; and upon the forward speed of the generator hull.

The primary difference between the parent and present inventions, on the one hand, and the existing art on the other, is that the existing art stresses the generating of "waves", as that term is commonly understood by those skilled in the art, while the parent and present invention focus on generating flows of water that replicate the shape and dimension of those particular portions of waves most desired by surfers, but without intending or needing to actually generate a "wave" to achieve the desired result.

The primary difference between the present invention and the parent invention is that the water in the present invention is propelled against the forming means to obtain the desired surface upon which surfing maneuvers can take place.

Other objectives and goals will be apparent from the following description, taken in conjunction with the drawings included herewith.

BRIEF DESCRIPTION OF THE DRAWINGS

FIG. 2 is a body view of a preferred embodiment of the forward face of the parent and present invention, with the line of sight being along, and opposite to, the relative direction of motion.

FIG. 3 is a profile view of a preferred embodiment of the forward face of the parent and present invention, with the line of sight transverse to the direction of motion and parallel to the surface of the water.

FIG. 4 is a plan view of a preferred embodiment of the forward face of the parent and present invention, with the line of sight from above and normal to the views of FIGS. 2 and 3.

FIG. 5 is a plan outline view of the parent and present invention, disclosing the range of horizontal attitude, with respect to its relative direction of motion, which the generator can take and still form a tunnel wave.

FIG. 6 is a view in profile of a typical cross-section of the parent and present invention, disclosing the range of inclination, with respect to its relative direction of motion and the surface of the water, which it can take and still form a tunnel wave.

DETAILED DESCRIPTION OF THE PRESENT INVENTION

Because the parent invention and the present invention are operated in water, and many of the results of its passage therethrough, or the propelling of water against the wave generator thereof, are similar to those caused by a boat hull, many of the terms used in the following description will be nautical or marine terms, as they constitute a ready-made and appropriate vocabulary which is generally understood by those skilled in the art.

Further, it will be understood by those skilled in the art that much of the description of the structure and function of the wave generator of the parent application will apply to that embodiment of this application wherein water is propelled against the wave generator described in the parent application. Therefore, the description of the wave generator of the parent application should also be read in conjunction with FIG. 8, unless distinction is made in the description hereinafter.

Figure 1:
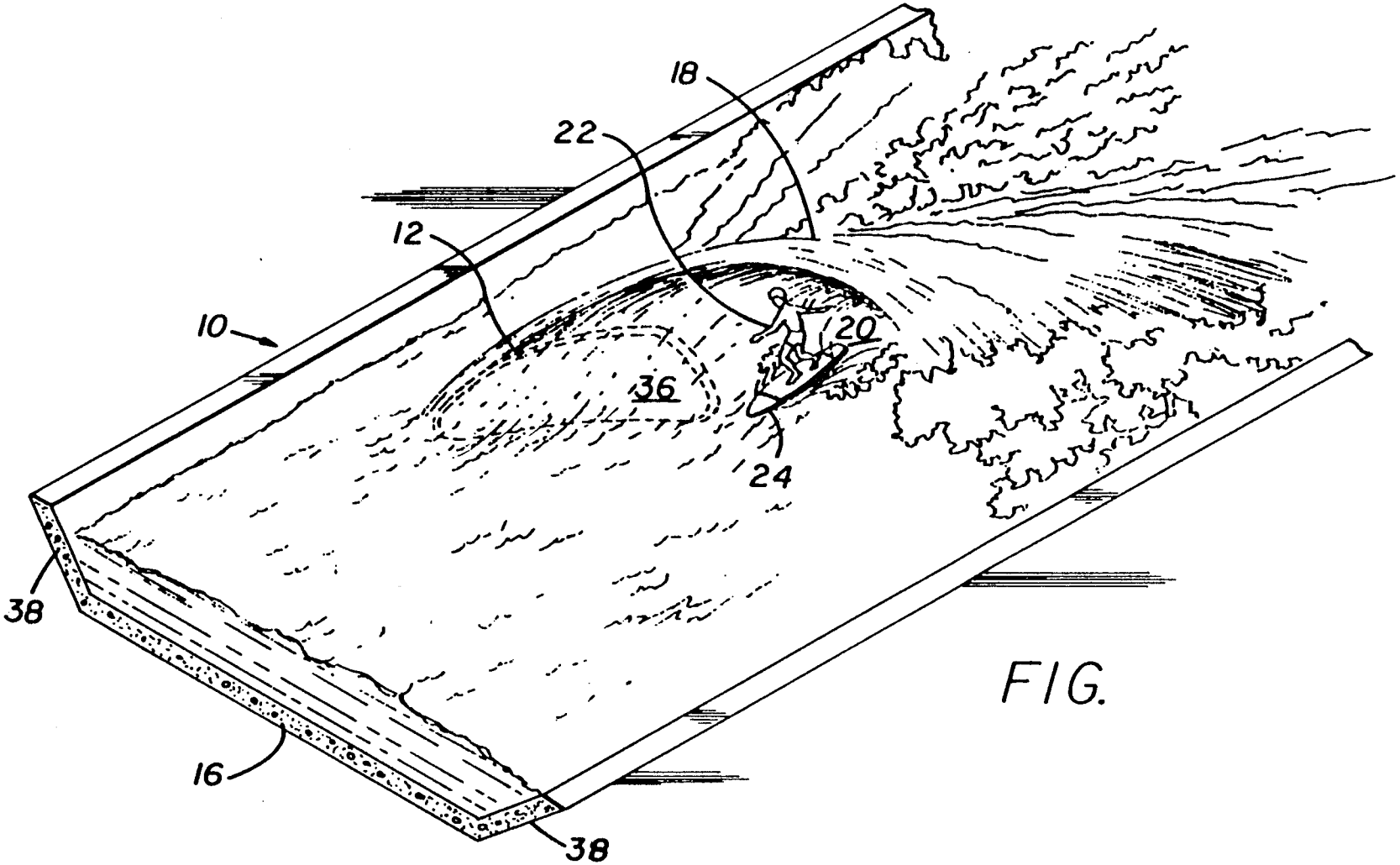
FIG. 1 depicts a tunnel wave of the desired configuration, generated by the parent invention as it moves through a body of water.

Turning now to FIG. 1, we see parent invention 10, which includes novel wave-forming generator body or hull 12 (shown in dashed outline) moving through water 14 contained in longitudinal channel 16, to form tunnel-wave 18, suitable for surfing. "Mouth" or opening 20 of tunnel wave 18—"the chute" or "the pipeline", as surfers refer to it—is clearly defined and, with generator 12 of an appropriate size, opening 20 will be large enough to accomodate fully-grown person 22 on a full-sized surf board 24. It will be seen by those skilled in the art that, as generator 12 moves through water 14, tunnel-wave 18 will move outward and fall behind at an angle depending upon the speed of generator 12. Surfer 22, while moving downward and across the face of wave 18, will also be moving along the length of channel 16 at substantially the same speed as generator 12.

Generator 12, to generate a tunnel-wave 18 of adequate size to accomodate an adult surfer, would have outside dimenions of approximately 5 to 6 feet in height, from 15 to 25 feet in length, and would move along channel 16 at a preferred speed of 10–12 miles per hour. Channel 16 can be whatever length and width is desired and economical to provide a satisfactory experience for users.

It will be recognized by those skilled in the art that the same functions and results will be true if generator 12 is stationary and water 14 is moving with respect thereto, and channel 16 is as long as is necessary to allow at least one surfer to execute the various maneuvers appropriate to surfing in a tunnel wave. Of course, it will be more efficient and cost-effective if channel 16 is sufficiently long to accomodate several surfers simultaneously. All that is required for this preferred embodiment is a means, such as a pump, sufficient to propel the required quantity of water in channel 16 against generator 12 with sufficient velocity to form tunnel wave 18, plus a means to hold generator 16 in place with respect to the water as described hereinafter.

FIGS. 2–4 disclose generator hull 12. Several specific embodiments of this general shape are possible, as will be more fully described and explained hereinafter, but FIGS. 2–4 substantially disclose the desired form.

The cross-sectional and plan-sectional lines indicated in FIGS. 2–4 are solely for the purpose of indicating the three-dimensional shape in perspective, rather than being illustrative of specific frame, plan, and profile sections. Specific characteristics of curvature which will accomplish the purposes of the present invention are described more fully hereinafter. In FIG. 2, extended line 26 indicates the waterline in calm water on generator 12 in the parent, however, such is not important in the present invention. Stem portion 28 extends downward and forward from vertical 30, which intersects generator hull 12 at waterline 26. The distance which stem portion 28 extends forward from vertical 30, in terms of a proportion of the length of hull 12, can vary from 0% to as much as one-third, with the preferred extension being about one-fifth the length of hull 12.

The forward face of generator hull 12 is concave both vertically and horizontally, as will be described more fully hereinafter. Stem portion 28 acts as a scoop to channel and lift water into central portion 32 of the hull 12, and on to stern 34. The horizontal concavity creates forces tending to accelerate the displaced water outward along the face of generator hull 12. However, the water adjacent thereto creates a resultant force which propels the major portion of the displaced water along the path of least resistance, which is upward and outward along the vertical concavity, and eventually forward over the base 36 of wave 18, creating the desired tunnel shape with mouth or opening 20.

At least four characteristics of generator hull 12, specifically of its forward face, influence the size, shape, angle, and speed of the tunnel wave developed, and each of them interacts with the others:

A. its shape (FIGS. 2–4);

B. its attitude-its horizontal position or angle with respect to the direction of motion (FIG. 5);

C. its inclination-its vertical position or angle with respect to both the surface of the water and the direction of motion (FIG. 6); and D. the velocity of the water over the hull.

All of these are important to its performance in creating the desired tunnel wave:

A. forward face 32 of hull 12 has a complex shape, of a concave curvature, both vertically and horizontally, as indicated generally by the cross-section and plan section lines, which are substantially but not specifically illustrative of the range of possible shapes, as will now be explained more fully:

I. VERTICALLY:

a. the shape of the vertical curvature can be:

1. substantially a simple arc of a circle; or,
2. preferably, an arc of a more complex, changing, curve, e.g.:
   I). ellipse;
   II). parabola;
   III). hyperbola; or
   IV). spiral; if a changing curve, it preferably changes from a closing curve (i.e., the ascending water encounters a decreasing radius as it ascends the face of the hull) in the stem and mid-body, to an opening curve (i.e., the ascending water encounters an increasing radius as it ascends the face of the hull) in the stern;

b. the degree of curvature (i.e., the radius of curvature) also changes from the stem to the stern portion, with the radius of curvature (or the minimum curvature if a changing curve), changing from stem through mid-body to stern in the approximate ratio ranges of 1:3:5, with tolerances of 1:2.5–3.5:4–6; the minimum curvature at the stem is about 10% of maximum generator hull width; the maximum curvature at the stern is about 50% of maximum generator hull width;

c. the amount of curvature (i.e., the length of arc subtended in degrees) also changes from stem to stern, with the angle of arc changing from substantially 45° or less at the very tip of the stem, to substantially 90° at mid-body, to substantially 60° at the stern;

II. HORIZONTALLY:

a. the shape of the horizontal curvature can be:

1. substantially an arc of a circle, preferably; or
2. a portion of a more complex, changing, curve, e.g.:
   I). ellipse;
   II). parabola;
   III). hyperbola; or
   IV). spiral; if a changing curve, it would open (i.e., have an increasing radius) from stem to stern for more rapidly moving wave shapes, and close (have a decreasing radius) from stem to stern for slower wave shapes;

b. the degree of horizontal curvature (i.e., the radius of curvature) can vary between 0.75–1.25 of hull length, whether a changing curve or circular arc;

c. the amount of curvature (i.e., the length of arc it subtends, in degrees) can vary between substantially 30° to 50°, whether a changing curve or an arc of a circle;

B. as disclosed in FIG. 5, the horizontal attitude of the forward face with respect to the direction of waterflow, can vary only within certain limits, else the tunnel will not be developed:

I. the horizontal angle of the hull with respect to the direction of motion (FIG. 5):

a. the "forward" face of the stem as it contacts the water can vary from substantially parallel (0°) to the direction of motion to an angle of as much as 50°, with the prefered embodiment being about 25°; and C. as disclosed in FIG. 6, the inclination of the forward face with respect to both the direction of motion and the surface of the water, is also limited, else the tunnel will not be developed:

I. the vertical angle of the hull with respect to the surface of the water (FIG. 6):

a. the angle of the lower leading edge of hull 12 as it contacts the water can vary from substantially parallel (0°) to the surface thereof, to angle as great as 30°, with the preferred angle being substantially 15°;

D. the speed of the water over the generator also has a limited range. Below about 6 mph, the water will not be carried up and forward with sufficient velocity to form into a tunnel, with any reasonable shape, attitude or inclination of the face. Above about 20 mph, forces on the propelling structure, and required operating energy become very large, the turbulence developed creates instability of the shoreline structure of the channel, and other problems appear. The preferred range of speed is about 10–12 mph.

Of course, the vertical and horizontal position of the forward face must be adjusted as the speed is changed, that is, as the speed is increased, the attitude and inclination of the forward face must be decreased, and vice versa.

Figure 7:
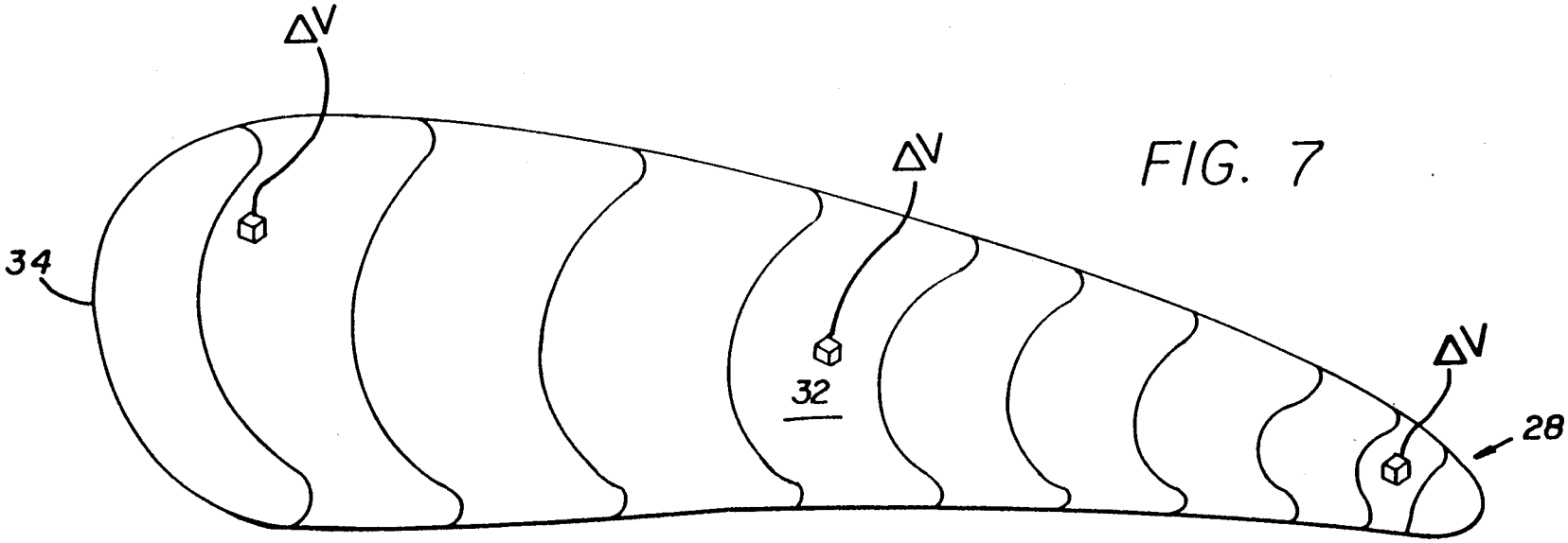
FIG. 7A–C is a generalized diagram of the various forces acting on an infinitesimal volume of water at different locations on the forward face of the generator hull of the parent and present invention.
Figure 7A:
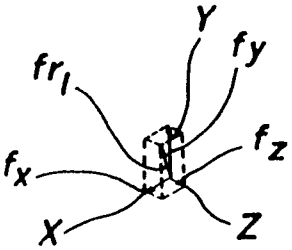
Figure 7B:
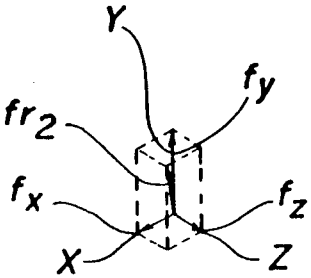
Figure 7C:
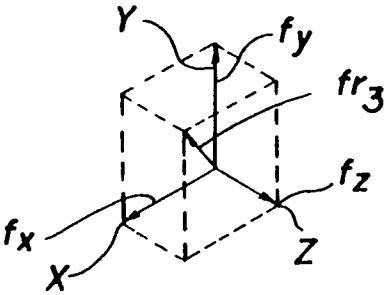

FIGS. 7A–C are generalized diagrams depicting the various idealized forces acting on an infinitesmal volume ΔV of water at stem 28, at midbody 32, and at stern 34 of the present invention, to help understand the action thereof in forming the desired tunnel shape:

A. in FIG. 7A, the resultant force $f_{r1}$, acting on ΔV at the stem 28, is due to the algebraic combination of:
   I. $f_z$, the force due to the relative motion of generator hull 12 and the water in direction z; this is very low if the forward surface of stem 28 is substantially parallel to the to the relative direction of motion of hull and the water 12;
   II. $f_y$, the upward force due to the inclination of generator hull 12 with respect to its relative motion, which is small but real; and perhaps
   III. $f_x$, the outward force due to the attitude of generator hull 12 with respect to its relative motion, depending upon whether or not the extreme forward tip of stem 28 is parallel with the direction of motion; Resultant force $f_{r1}$ forces—"scoops"—the water into the midbody section 32 of generator hull 12;

B. in FIG. 7B, the resultant force $f_{r2}$, acting on ΔV in the midbody 32, is due to the algebraic combination of:
   I. $f_z$, now increased over its previous value because of the outward and upward sweep of generator hull 12 with respect to its relative motion with respect to the water in direction z;
   II. $f_y$, now increased over its previous value because of the increased upward sweep—the inclination—of the surface of generator hull 12 with respect to its relative motion; and
   III. $f_x$, now increased over its previous value because of the increased outward sweep—the attitude—of generator hull 12 with respect to its relative motion;

the consequences of B.I., B.II., and B.III., above, are that ΔV is accelerated along the resultant force line $f_{r2}$, which is outward, upward and forward (as ΔV moves higher on generator hull 12); and C. in FIG. 7C, the resultant force $f_{r3}$ acting on ΔV at stern 34 of generator hull 12 is due to the algebraic sum of;
   I. $f_z$, now substantially increased over its previous values, due to the further outward sweep of hull 12 acting on the volume ΔV, forcing the water further and faster forward due to the relative motion of generator hull 12 to the water in direction z;
   II. $f_y$, also substantially increased over its previous values, due to the further upward sweep of hull 12 acting on volume ΔV, forcing the water further and faster upward, due to the inclination of generator hull 12 with respect to its relative motion; and
   III. $f_x$, also substantially increased over its previous values, due to the further outward sweep of generator hull 12 acting on volume ΔV, forcing the water further and faster outward with respect to its relative motion.

Resultant force $f_{r3}$ forces ΔV further upward, outward, and forward from the face of hull 12, to where the force of gravity exerts an increasing influence, causing ΔV to follow a parabolic path downward toward the base of wave 18, creating the desired tunnel, within or at mouth 20 of which expert surfer 22 can ride his board 24.

Generator hull 12 can be fabricated of any of several well known materials which are appropriate for the use intended. Formed metal, wood, fiberglass-reinforced plastic, or any such materials which will withstand the structural loads involved. A preferred embodiment includes a thick foamed plastic covering to provide protection to the surfers using the facility.

Channel structure 16 is preferably constructed with sloping sides 38, perhaps having a naturalistic treatment thereof to simulate the appearance of beaches. The depth of channel 16 suprisingly seems to have no influence on the formation of the wave, and therefore needs only be sufficient to provide a comfortable depth for a user 22 to recover from a tumble from board 24. The sides of channel 16 preferably slope downward at each end.

It will be recognized by those skilled in the art that where water 14 is propelled against stationary wave-shape generator 12, the area of channel 16 need be only large enough to provide room to perform appropriate surfing manuevers, since the mouth of tunnel wave 18 remains more-or-less stationary with respect to the containment structure 38. Thus, such a structure could be constructed even in a back yard.

It will also be recognized by those skilled in the art that tunnel waves need not be the only wave form generated. For example, a very simple water surface form, which would be particularly useful for those learning to surf, would be that disclosed in FIG. 9. Containment structure **38*a* is constructed of concrete, fiberglass, waterproof plywood, or the like structural materials, to provide an adequate housing for the water and associated pumping equipment. Structure 38*a* can be partially sunk into the ground, as shown, placed upon the surface, or located in any other convenient manner. Housing 40 could contain the pumping equipment required to impart a momentum to water 14, at sufficient velocity to carry it to the top of ramp 42, so that no significant buildup of water occurs at the bottom of ramp 42**.

The surface 44 of the water will be inclined, depending upon several factors:

1. the slope necessary to enable surfboard 24 to slide down the slope with a velocity which will substantially balance the water velocity. This will be lower for beginning surfers and greater for advanced surfers;
2. the velocity necessary to impart a momentum to a given volume of water sufficient to carry it at least to the top of ramp 42;
3. the depth of water needed to perform desired surfing manuevers.

Figure 10:
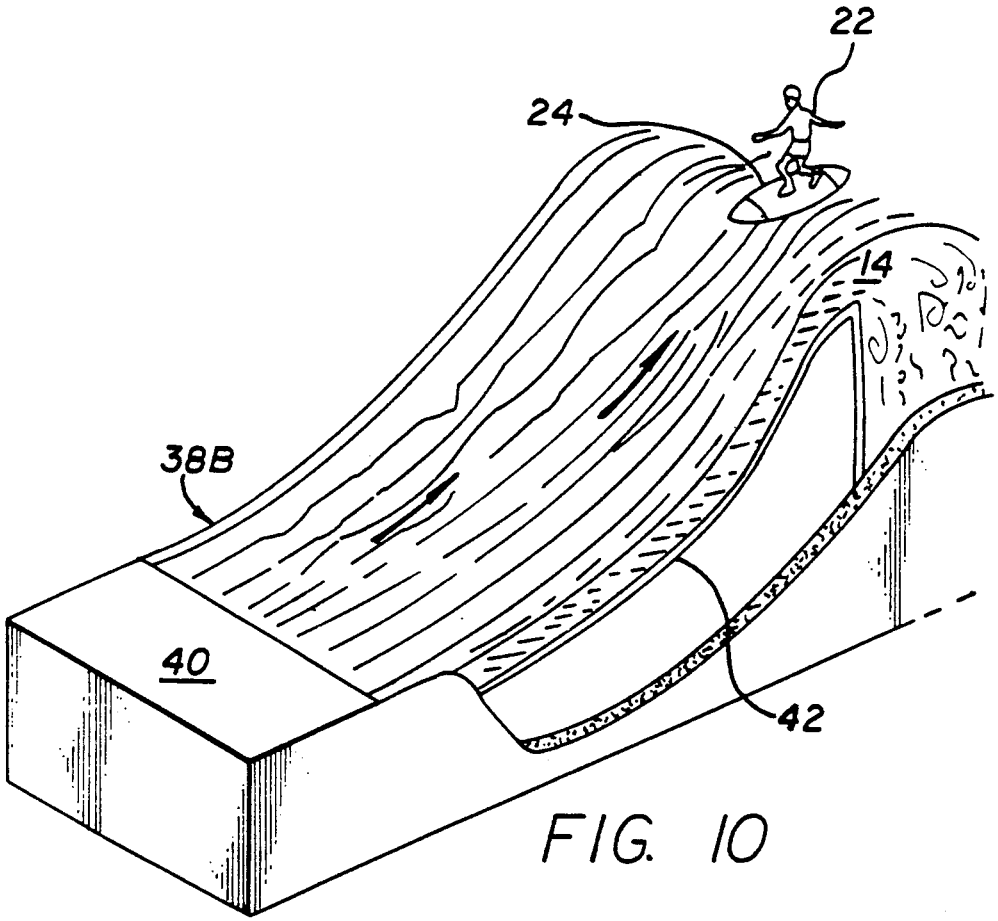
FIG. 10 discloses a structure to develop a flow of water over or on the generator of FIG. 9, on the top of which surfers can manuever.

A further embodiment is one in which water 14 has a velocity which will carry a sufficient volume of water across and outward from the upper lip of the ramp to form a curl upon which expert surfers can manuever, as disclosed in FIG. 10. This could also be performed on the top of the tunnel wave of FIG. 2. This type of manuever has heretofore been performed only in the open surf of the ocean.

Figure 8:
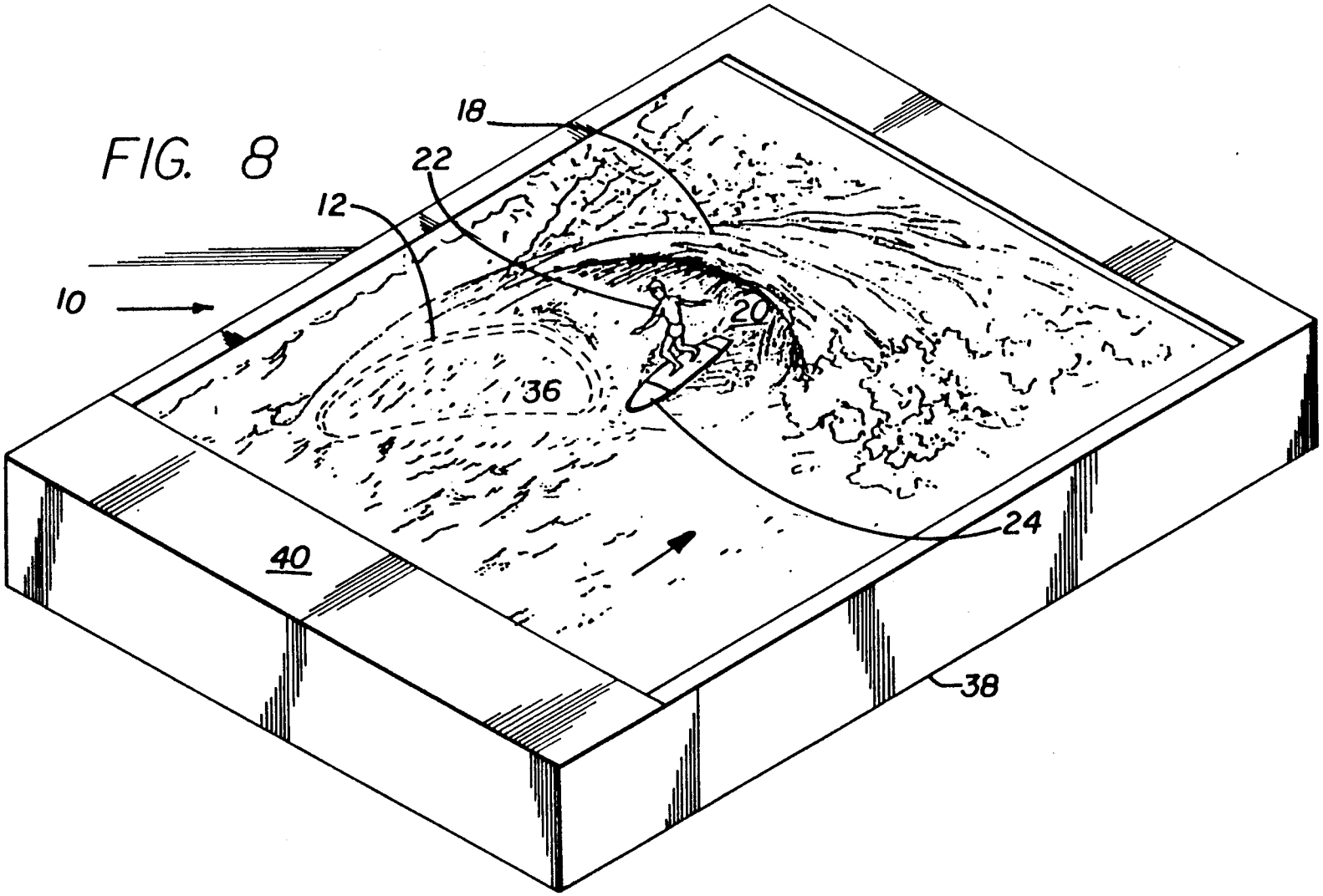
FIG. 8 depicts an apparatus for generating a tunnel wave of the desired configuration, generated by propelling a quantity of water against the generator of FIGS. 2–7.
Figure 9:
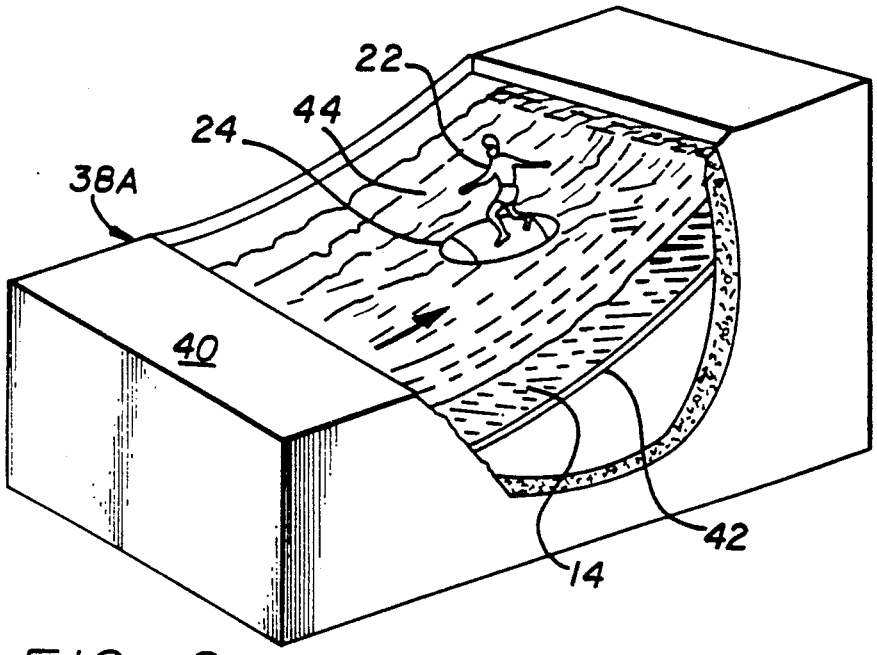
FIG. 9 is a generalized view of a generator for generating a stably-shaped body of water with an inclined surface thereon of sufficient area and depth for surfing manuevers.

Those skilled in the art will immediately recognize that other shapes and structures could easily be fabricated to obtain other waveforms, falling between the simple inclined surface of FIG. 9 and the tunnel wave of FIGS. 1 and 8.

Obviously, design precautions will be necessary to prevent a surfer who tumbles from his board from being drawn into the pumping machinery.

As will be recognized by those skilled in the art, certain modifications and changes can be made without departing from the spirit or intent of the present invention. For example, the curvatures given as examples for the forward face do not have to be geometrically precise; approximations are sufficient. The same is true of limits in angles, radii and ratios. The temperature and density of the water will have some difference, although the range of temperatures in which surfers would be comfortable is fairly limited. On the other hand, the difference in density between fresh and salt water could make a significant difference in operation, all other things being equal, and water of a density found in the Dead Sea would make a substantial difference in the limits heretofore described.

The terms and expressions which have been employed in the foregoing specification are used therein as terms of description and not of limitation, and there is no intention, in the use of such terms and expressions, of excluding equivalents of the features shown and described, or portions thereof, it being recognized that the scope of the invention is defined and limited only by the claims which follow.

What we claim as our invention is:

1. A water ride facility, comprising:

an inclined surface having a lower portion and an upper portion, said inclined surface terminating along said upper portion to permit water to flow outwardly over said upper portion;

a declined surface adjoining said inclined surface extending substantially downwardly from said upper portion of said inclined surface to permit water to flow downwardly from said upper portion;

an inclined side member on each side of said inclined surface extending longitudinally from said lower portion to said upper portion to contain water on said inclined surface; and means for propelling a volume of water upwardly from said lower portion to said upper portion of said inclined surface, wherein said volume of water is propelled upwardly at a velocity enabling said volume of water to flow over said upper portion of said inclined surface, whereby said outward flow forms an outwardly extending wave-like shape curling across said upper portion of said inclined surface, whereby surfing and other water skimming-type maneuvers can be performed on said wave-like shape.

2. A water ride facility, comprising:

an inclined surface having a lower portion and an upper portion, said inclined surface terminating along said upper portion to permit water to flow over said upper portion;

means for propelling a volume of water upwardly from said lower portion to said upper portion of said inclined surface, wherein said volume of water is propelled upwardly at a velocity enabling said volume of water to flow over said upper portion of said inclined surface, whereby said outward flow forms wave-like shape curling across said upper portion of said inclined surface, whereby surfing and other water skimming-type maneuvers can be performed on said wave-like shape.

3. The water ride of claim 2, further comprising a tunnel wave formed on said upper portion.

4. A water ride facility, comprising:

an inclined surface with a lower portion and upper portion;

means for propelling a volume of water upwardly from said lower portion to said upper portion of said inclined surface, wherein said volume of water is propelled upwardly at a velocity enabling said volume of water to flow over said upper portion of said inclined surface to form an outwardly extending wave-like shape curling across said upper portion of said inclined surface, whereby surfing and other water skimming-type maneuvers can be performed on said wave-like shape; and means for generating a wave affixed to said inclined surface, said generating means having a forward face, a portion of said volume of water flowing up and across said forward face to form a tunnel-like wave shape upon which surfing and other skimming maneuvers can be performed, and wherein said water is propelled up and over said upper portion of said inclined surface.

* * * * *

UNITED STATES PATENT AND TRADEMARK OFFICE

CERTIFICATE OF CORRECTION

PATENT NO. : 5,171,101
DATED : December 15, 1992
INVENTOR(S) : Thomas J. Lochtefeld, et. al.

It is certified that error appears in the above-indentified patent and that said Letters Patent is hereby corrected as shown below:

Column 12, line 18, delete "outward".

Column 12, line 19, between "forms" and "wave-like" insert --a--.

Signed and Sealed this

Twenty-second Day of February, 1994

*Attest:*

Bruce Lehman

BRUCE LEHMAN

*Attesting Officer*

*Commissioner of Patents and Trademarks*